United States Patent [19]

Lass

[11] 4,208,239

[45] Jun. 17, 1980

[54] DRY WALL TAPING MACHINE HAVING AN IMPROVED APPLICATOR HEAD

[75] Inventor: Harold M. Lass, San Jose, Calif.

[73] Assignee: Corban Industries, Inc., San Jose, Calif.

[21] Appl. No.: 848,729

[22] Filed: Nov. 4, 1977

Related U.S. Application Data

[63] Continuation-in-part of Ser. No. 739,518, Nov. 8, 1976, abandoned.

[51] Int. Cl.[2] ..... B44C 7/02

[52] U.S. Cl. ..... 156/575; 156/577; 156/579

[58] Field of Search ..... 156/523, 524, 526, 527, 156/574, 575, 577, 578, 579; 15/27, 235.4, 244 A

[56] References Cited

U.S. PATENT DOCUMENTS

| | | | |
|---|---|---|---|
| 2,502,499 | 4/1950 | Ames | 156/578 |
| 2,815,142 | 12/1957 | Ames | 156/526 |
| 3,099,855 | 8/1963 | Nash | 15/244 A |
| 3,116,195 | 12/1963 | Lathrop et al. | 156/575 |
| 3,131,108 | 4/1964 | Kennard | 156/575 |
| 3,188,262 | 6/1965 | Torrison | 156/575 |
| 3,260,638 | 7/1966 | Hoveland | 156/575 |
| 3,625,798 | 12/1971 | Ihli | 156/574 X |
| 3,880,701 | 4/1975 | Moree | 156/575 X |
| 3,968,001 | 7/1976 | Lockwood | 156/577 X |
| 3,969,180 | 7/1976 | Ravesloot | 156/577 X |
| 4,003,781 | 1/1977 | Holsten | 156/526 |

*Primary Examiner*—Michael G. Wityshyn
*Attorney, Agent, or Firm*—Harry E. Aine; Harvey G. Lowhurst

[57] ABSTRACT

A hand operated dry wall taping tool includes a tubular main body portion, to be held by the operator, with a tape applicator head portion at one end thereof. The tool is supplied with dry wall tape cement from a supply thereof under pressure. A supply roll of dry wall tape is carried from the main body of the applicator, the tape is fed through the applicator head onto the wall joint to be taped. In the applicator head, a pair of tape drive wheel portions engage the tape and press it against the wall for taping a seam between two adjacent sections of dry wall. As the drive wheels pull the tape through the applicator head, dry wall cement is applied by the applicator head to the side of the tape which is to engage the wall. In one embodiment, a spring biased swivel roller presses the cement laden tape into engagement with the wall as the tape is applied to the seam. In an alternative embodiment, a flexible resilient wiper blade carried from the head presses the cement laden tape into engagement with the wall and in addition feathers the cement onto the dry wall along both side edges of the tape with but a single pass.

5 Claims, 10 Drawing Figures

DRY WALL TAPING MACHINE HAVING AN IMPROVED APPLICATOR HEAD

RELATED CASES

This application is a continuation-in-part of parent application Ser. No. 739,518 filed Nov. 8, 1976 for "Dry Wall Taping Machine Having an Improved Applicator Head" by Harold M. Lass now abandoned in favor of the present application.

BACKGROUND OF THE INVENTION

The present invention relates in general to dry wall taping tools and more particularly to such a tool having an improved applicator head for applying the cement laden tape to the wall to be taped.

DESCRIPTION OF THE PRIOR ART

Heretofore, dry wall taping tools have included an applicator head with a pair of tape drive wheels for engaging the tape and pressing the tape into engagement with the wall to be taped so that as the operator moves the applicator head along a seam to be taped, the drive wheels pull the tape from a supply reel through a dry wall cement dispensing slot in which cement is dispensed onto the side of the tape which is to face the wall. The tape drive wheels engage the marginal side edges of the tape so that the central region of the tape is not pressed into engagement with the wall nor is the cement squeezed or otherwise pressed into the seam to be taped. Subsequently, a tool is utilized for squeezing the excess cement from the spaces in between the tape and the wall. A tape applicator of this character is disclosed in U.S. Pat. Nos. 3,260,638 issued July 12, 1966 and 2,815,142 issued Dec. 3, 1957.

It has heretofore been proposed to provide a pressure plate between the two drive wheels for pressing the cement laden tape onto a flat wall joint. The pressure plate was manipulated by the operator for moving the pressure plate into and out of engagement with the cement laden tape. When it is desired to fold the tape into a corner, the pressure plate is removed and a disc substituted. Such a taping tool is disclosed in U.S. Pat. No. 2,502,499 issued Apr. 4, 1950.

One of the problems associated with this latter pressure plate arrangement is that the pressure plate will not bear evenly against the tape and wall unless the taping tool is held so that the pressure plate is parallel to the surface of the wall. This is particularly difficult to achieve when a horizontal seam is being taped and the seam is above or below a convenient region to be reached by the operator while holding the tool in the horizontal plane. If the tool is held out of the horizontal then an uneven pressure is obtained across the transverse dimension of the tape. Also, interchanging of the pressure plate and cornering disc is time consuming and difficult in practice.

SUMMARY OF THE PRESENT INVENTION

The principal object of the present invention is the provision of a dry wall taping tool having an improved applicator head of the type in which means are provided for pressing the cement laden tape into contact with the wall being taped.

In one feature of the present invention, the applicator head of a dry wall taping tool includes a pressure means pivotably arranged so that the taping tool may be canted at an angle to the wall being taped while maintaining uniform pressure against the cement laden tape as applied to the seam being taped.

In another feature of the present invention, the pressure applying means is spring loaded to maintain a uniform pressure against the tape and wall regardless of the angle that the taping tool makes with the wall.

In another feature of the present invention, the pressure applying means comprises a pivotable roller.

In an alternate feature of the present invention, the pressure applying means comprises a pivotably wiping blade for additionally feathering the cement into the wall along the side marginal edges of the cemented tape.

In another feature of the present invention the pressure applying means is attached to the head portion of the tape tool via the intermediary of a quick disconnect fitting, whereby alternative pressure applying means may be readily interchanged in use.

Other features and advantages of the present invention will become apparent upon a perusal of the following specification taken in conjunction with the accompanying drawings wherein:

DESCRIPTION OF THE PREFERRED EMBODIMENTS

Figure 1:
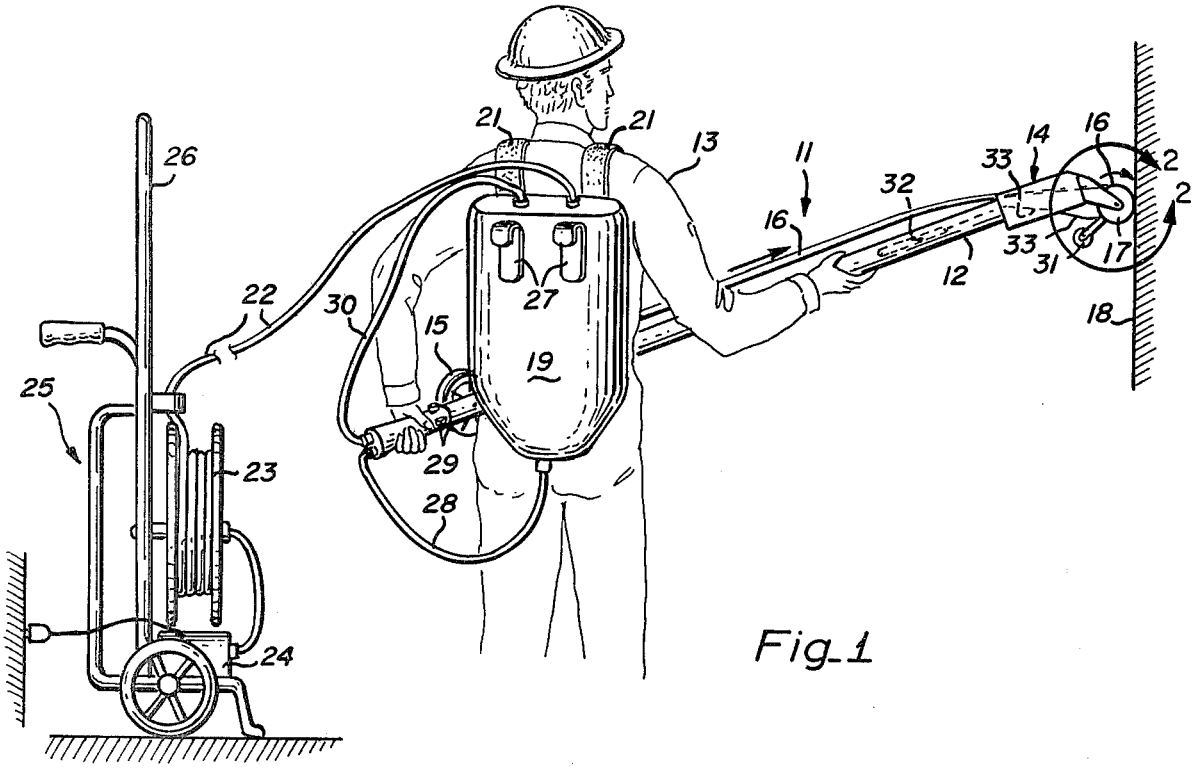
FIG. 1 is a side elevational view of the dry wall taping tool in use.

Referring now to FIG. 1, there is shown a dry wall taping tool 11 of the present invention. More particularly, the dry wall taping machine or tool 11 includes an elongated tubular body or barrel portion 12 to be hand held by the operator 13 so that an applicator head portion 14 of the tool 11 is disposed adjacent a seam which is to be taped between two adjoining sections of dry wall. A supply roll 15 of dry wall tape 16 is carried on a support pivotably affixed to the body or barrel 12. Tape 16 is fed from the roll through the applicator head portion 14 over a pair of tape drive wheels 17 which press the marginal edges of the tape 16 into engagement with the wall 18 and which in so doing serve to pull the tape 16 from the roll 15.

The tape 16 is drawn through a dry wall cement applicator box portion of the head 14 wherein dry wall cement is applied to the upper surface of the tape so that as the tape is applied to the wall 18, cement is trapped between the tape and the wall. A pivotable roller, more fully disclosed below with regard to FIGS. 2–5, presses the cement laden tape into firm engagement with the wall and the seam to facilitate adhesion of the tape 16 to the wall 18.

The dry wall cement is supplied to the applicator head 14 from a tank 19 carried via shoulder straps 21 from the shoulder of the operator 13. The cement tank 19 contains a supply of dry wall cement and the tank is pressurized to a pressure of 35–40 psi via an air line 22 wound on a spring loaded supply reel 23 and thence connected to an air compressor 24 via a suitable pressure regulator, not shown. The compressor and supply reel are carried from a hand truck 25 which includes an extendable frame member 26 to receive and support the tank, when not in use, via hooks 27 affixed to the tank and hooked over an upper horizontal cross member of the frame 26.

Dry wall cement is supplied from the tank 19 to the taping tool 11 via tubing 28. Suitable hand operated valves 29 are disposed at the outer end of the body 12 for operation by the thumb of the operator for controlling certain functions of the taping tool 11. One valve controls the flow of dry wall cement from the tank 19 to the applicator head 14. Another valve controls air pressure to a pneumatic cylinder for operating a shear, and advancing the tape 16. Another valve controls air pressure to a second pneumatic cylinder 32 for operating a cornering wheel 31. The pneumatically operated cylinder 32 is mechanically coupled to the cornering wheel 31 via a cable 33 such that when the air pressure as supplied to the various cylinders from the tank 19 via air line 30 is relieved on the pneumatic cylinder 32 a spring mechanically associated with the cornering wheel 31 pivots the cornering wheel into the operating position where it remains so long as the operator depresses the pneumatic control valve for releasing the pressure on the cylinder 32. After the cornering wheel operation, more fully described below, is completed, the operator releases the pneumatic control valve and reapplies the pressure to the cylinder 32, thereby withdrawing the cornering wheel via cable 33 against its spring pressure. After the tape has been applied to the wall, conventional finishing tools are employed for smoothing the tape 16 and removing the excess dry wall cement.

Figure 2:
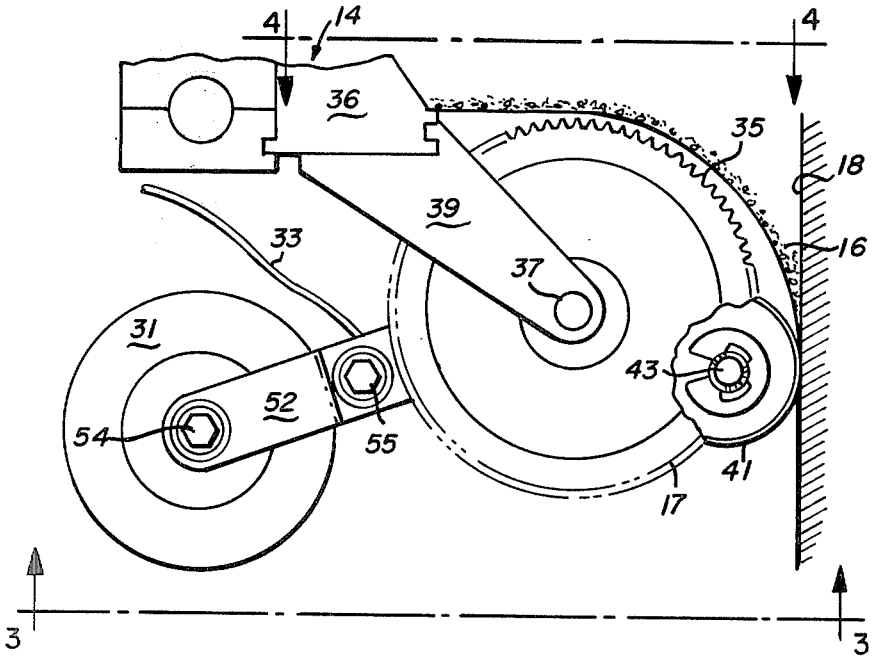
FIG. 2 is an enlarged side elevational view, partly broken away, of a portion of the structure of FIG. 1 delineated by line 2—2.
Figure 3:
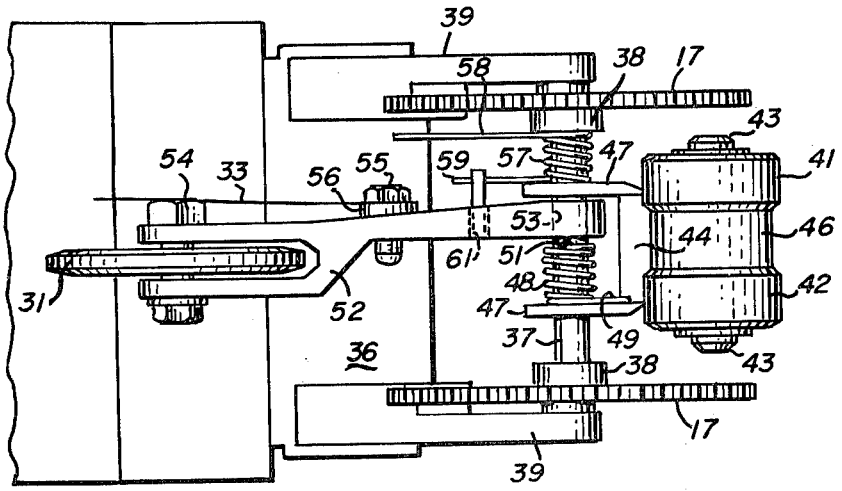
FIG. 3 is a bottom view of the structure of FIG. 2 taken along line 3—3 in the direction of the arrows.
Figure 4:
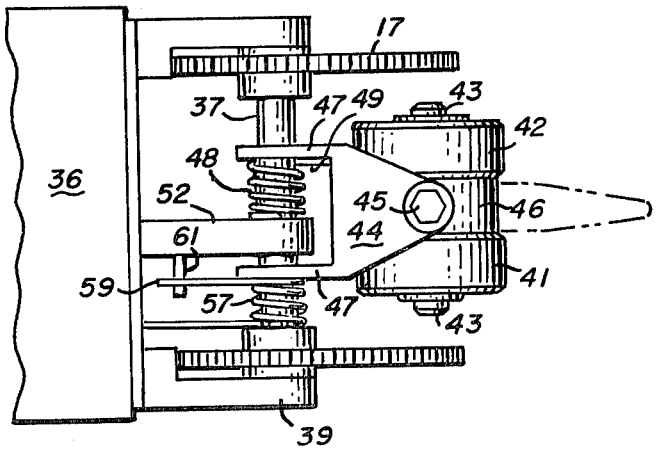
FIG. 4 is a top view of the structure of FIG. 2 taken along line 4—4 in the direction of the arrows.

Referring now to FIGS. 2–4, the features of the pivotable means for pressing the cement laden tape to the wall, cornering wheel 31 and drive wheels 17 will be explained in greater detail. Each of these drive wheels 17 includes an outer serrated rim portion 35 to grip the paper tape 16 to facilitate pulling of the tape 16 through the dry wall cement applicator box 36. The drive wheels 17 are carried form an axle 37 via central hub portions 38. The axle 37 is carried from the applicator head 14 via the intermediary of a pair of arms 39 affixed to the bottom of the cement applicator box 36.

In a preferred embodiment a pair of roller wheels 41 and 42, as of Teflon, are disposed intermediate the tape drive wheels 17 for rolling engagement with the cement laden tape 16 for pressing the cement laden tape 16 into engagement with the wall 18 to facilitate adhesion between the tape 16 and the wall 18. The roller wheels 41 and 42 are carried from an axle 43 which, in use, is directed parallel to the wall and perpendicular to the seam to be taped. Axle 43 is pivotably carried from a yoke 44 via a pivot shaft 45 joined to the central region of the axle 43 in the manner of a "T" connection. The pivot shaft 45 passes through a radial bore in a cylindrical spacer 46, as of Teflon, disposed intermediate the roller wheels 41 and 42, respectively. The pivot shaft 45 is pivotably coupled to the yoke 44 to permit pivoting of the roller wheel assembly about the longitudinal axis of the pivot shaft 45, thereby allowing the roller wheels 41 and 42 to pivot so as to be always parallel to the wall being taped.

The yoke 44 is pivotably captured onto the drive wheel axle 37 via apertured arm members 47. A helical torsion spring 48 is wound around the axle 37 having one leg 49 captured to the yoke 44 and the other end of the torsion springs fixedly captured to the axle 37 at 51 so that the yoke 44 and attached roller wheels 41 and 42 are spring biased into engagement with the cement laden tape 16 and the wall 18 as shown in FIG. 2. The roller wheels 41 and 42 serve to press the cement laden tape onto the wall 18 and seam being taped to promote adhesion of the tape 16 to the wall 18.

The cornering wheel 31 is carried from the drive wheel axle 37 at a position intermediate the arms 47 of the yoke 44 via a bifurcated arm 52. The arm 52 is pivotably connected to the axle 37 via a bore 53 in one end of the arm. The cornering wheel 31, as of Teflon, is carried from the opposite end of the arm 52 via an axle 54. The actuating cable 33 is fixedly secured to the central region of the arm 52 via a screw 55 and washer 56. A helical torsion spring 57 is coaxially mounted of the axle 37 with one leg 58 thereof captured by the bottom surface of the dry wall cement applicator box 36 and the other end 59 is captured behind a pin 61 extending through the arm 52.

The torsion spring 57 is torsionally compressed so that the arm 52 and cornering wheel 31 are tensioned against cable 33. When the air pressure is released on the corner wheel pneumatic actuating cylinder 32, the spring 57 pivots the cornering wheel 31 to the operating position indicated in phantom lines in FIG. 4. The cornering wheel engages the median line of the cement laden tape 16 and folds and forces the tape into the corner seam being taped. When the operator releases the valve 29 and again permits the pneumatic air pressure to be applied to the corner actuating cylinder 32, the cornering wheel is retracted to its storage position against the spring biasing force of torsion spring 57, as shown in FIG. 2.

As an alternative embodiment to the use of roller wheels 41 and 42 for pressing the cement laden dry wall tape into engagement with the seam and wall 18, the roller may be replaced by a curved pressure plate, such as a section of a cylinder preferably coated with low friction material, such as Teflon. The plate would be pivotably mounted to the yoke 44 via the pivot shaft 45 with the axis of revolution of the cylindrical section being parallel to axle 43, in the same manner as the roller wheels 41 and 42 are pivoted to the yoke 44. This would allow the pressure plate to tilt so as to remain parallel to the wall being taped.

Referring now to FIGS. 5–8, there is shown a preferred alternative embodiment of the present invention. In the embodiment of FIGS. 5–8, the tape drive wheel 17' comprises an outer cylindrical portion 71 with three axially spaced annular land portions 72, 73 and 74 extending outwardly from the surface 71. Land portions 72 and 74 are at opposite ends of the cylindrical portion 71 and the intermediate land portion 73 is centrally disposed of the cylindrical portion 71. The end land portions are serrated to form teeth, in the manner as previously described with regard to drive wheels 17, for engaging the tape and pulling the cement laden tape from the reel of tape 15 through the cement dispensing box 36 and for applying the cement laden tape to the wall 18.

A flexible resilient scraping blade 75 is pivotably carried from the head portion 14 of the tool by means of a yoke 76 of generally U-shape having a pair of laterally spaced arm portions 77′ and interconnected via a laterally extending cross portion 78. Arm portions 77′ are apertured in alignment with the axle 37 for the drive wheel 17′ and are pivotably affixed on the axle 37. Arm member 77′ includes a lever portion 79 extending past the pivot point on the axle 37 and said level portion 79 is pivotably linked to a connecting link 81 at pivot 82.

Link 81 is coupled to the end of the actuating cable 33 via the intermediary of a lug 83 swaged onto the end of the cable 33. The lug 83 fits within a hollow cylindrical coupling member 84 affixed to the end of the link 81. A slot 85 extends longitudinally of the cylindrical coupler 84 at an angle canted to the longitudinal axis of the cylindrical coupler 84 to accommodate the passage of the cable 33 through the slot in such a manner that the cable 33 may be readily coupled to the link 81, but due to the canting of the slot 85, the cable 33, when under tension or force in the axial direction of the cable, does not readily permit the cable to be disconnected from the cylindrical coupler 84.

The cable 33 is contained within an outer cylindrical shield 86, the extent of the cable 33 which extends out of the end of the shield 86 is relatively stiff so that it can serve to push the linkage 81 axially and away from the end of the shield 86 without producing excessive deflection or bending of the cable 33. A stop pin 87 is affixed to the arm 39 extending outwardly therefrom and serves as a stop to prevent the pivoted linkage 81 and yoke 76 from passing through the angular relationship wherein the link member 81 and the arm 77′ are coaxial, i.e., a dead center position.

Unlike the embodiment of FIGS. 1–4, the cable 33 is connected to the plunger of the pneumatic actuating cylinder 32, as shown in FIG. 1, with the exception that the plunger of cylinder 32 is spring biased so that when the air pressure is released on the cylinder 32, the spring forces the plunger forward causing the cable 33 to push the linkage 81 toward the wall 18 and to pivot the yoke 76 away from the wall. On the other hand, when air pressure is applied to the pneumatic cylinder 32, the piston therein moves against the spring force retracting the cable 33 within the shield 86 and causing the yoke 76 to pivot toward the wall 18 about the axle 37. The pneumatic pressure in the cylinder 32 causes the yoke 76 to be resiliently biased toward the wall 18.

The scraping blade 75 is coupled to the cross arm member 78 of the yoke 76 via the intermediary of a spring clip 88 which clips over the cross arm member 78. The clip 88 is pivotably connected to the wiper blade 75 via the intermediary of a mounting block 89, as of Teflon, fixedly secured to the scraping blade 75 via the intermediary of screws 91, such block 89 being pivotably connected to the clip 88 via the intermediary of a pivot pin 92. The pivot pin 92 is generally centrally disposed of the block 89 and blade 75 and passes through an oversized bore 93 in the block 89. In addition, a nut 94 is affixed to the end of the pivot pin 92 in such a manner as to provide approximately 0.030 inch of axial play of the block along the pin 92.

Figures 5, 6, 7, 8, 9, 10:
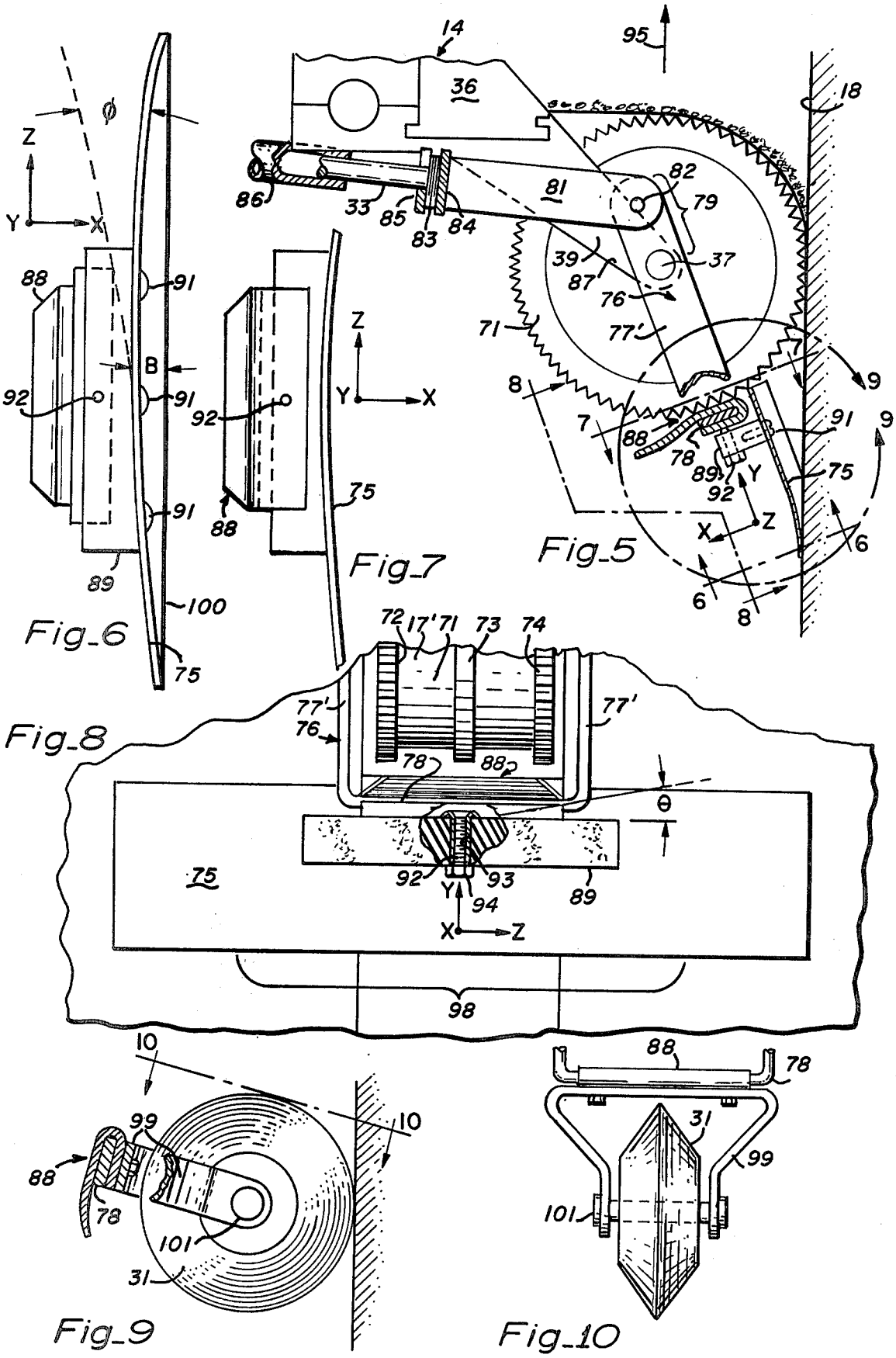
FIG. 5 is a view similar to that of FIG. 2 depicting an alternative embodiment of the present invention.
FIG. 6 is a bottom view of a portion of the structure of FIG. 5 taken along line 6—6 in the direction of the arrows.
FIG. 7 is a top view of a portion of the structure of FIG. 5 taken along line 7—7 in the direction of the arrows.
FIG. 8 is an end view of a portion of the structure of FIG. 5 taken along line 8—8 in the direction of the arrows.
FIG. 9 is a side view partially broken away, and similar to that portion of FIG. 5 delineated by line 9—9 and depicting an alternative embodiment of the present invention.
FIG. 10 is a view of a portion of the structure of FIG. 9 taken along line 10—10 in the direction of the arrows.

The blade 75, at its upper edge, overlays the clip 88 and transverse bar 78 in such a manner that pivoting action of the blade 75 about the pivot 92 or pivot axis Y in the Cartesian coordinate system is limited to an angle $\phi$, as of plus or minus 10° to 20° from the Z axis, as indicated in FIG. 6. The enlarged bore 93 and the axial slop between the block 89 and the clip 88 permits the blade 75 to also pivot about the X axis in the aforedescribed coordinate system, as shown in FIGS. 5–8, such X axis passing through the pin 92 at a point substantially midway of its length. This pivoting motion about the X axis is limited, by an interference between the block 89 and the transverse arm member 78 of the yoke 76, to an angle $\theta$ of approximately plus or minus 10° to 20°. Of course, as previously mentioned, the blade 75, as carried on the yoke 76, pivots about the Z axis in the aforedescribed coordinate system, such Z axis being coaxial with the axle 37.

The blade 75, in a typical example, is made of a spring stainless steel material, as of 0.015 inches thick and 6 inches in length with a width of 1.25 inches. Furthermore, the blade 75 is bowed with a radius of curvature extending forwardly or along the direction of advancement of the tool along the seam as indicated by arrow 95. The amount of bowing, in a typical example, is such that the space B between a cord 100 and the point of maximum deviation from the cord is approximately one-eighth of an inch, see FIG. 6.

In use, the blade 75, at the start of a typical seam, is pivoted out of the way in the clockwise direction as shown in FIG. 5 by releasing the air pressure on the pneumatic cylinder 32 and permitting the spring on the cylinder 32 to pivot the yoke 76 and blade 75 in the clockwise direction away from the wall 18. This permits the operator to press the drive wheel 17′ in closer to a corner or in closer to an intersecting wall. After the operator has started taping of the seam by advancing the taping tool in the direction of advancement 95 along the seam, the operator actuates a thumb actuated valve to apply pneumatic pressure to the pneumatic cylinder 32, thereby pivoting the yoke 76 in the counter-clockwise direction, as shown in FIG. 5, and causing the blade 75 to come into contact with the tape 16 and the wall 18.

The air pressure in the cylinder 32 keeps a resilient pressure or force on the blade 75 forcing it against the wall 18. As the blade 75 advances along the taped seam, the excess cement deposited on the tape 16, and thus between the tape 16 and the wall 18, is squeezed out from under the tape 16 along opposite side marginal edges of the tape and is feathered onto the wall in a region approximately two to three times the width of the tape as shown at 98 in FIG. 8. Thus, the scraping blade 75 smoothes the tape, squeezes the excess cement from under the tape and feathers the excess cement onto the wall, thereby producing a finished seam. This is accomplished in one pass. The prior art required two passes over the wall. More particularly, in the prior art, the cement laden tape was merely pressed against the wall and subsequent feathering of the cement and smoothing of the tape was accomplished by a second tool in a second pass along the seam. Thus, a significant advantage to the use of the blade embodiment of FIGS. 5–8 is that the blade 75, as a pressure means, accomplished in a single pass that which had heretofore required two passes. This substantially reduces the labor involved in taping a given seam.

Referring now to FIGS. 9 and 10, there is shown a cornering wheel alternative embodiment of the present invention. In the embodiment of FIGS. 9 and 10, the cornering wheel 31 is carried on an axle 101 which is affixed to a yoke 99 which in turn is coupled to the clip 88 of a design substantially identical to that previously described with regard to FIGS. 5–8. The clip 88 is clipped to the cross arm member 78 of the yoke 76. The clip 88 is a spring member and provides a quick disconnect coupler for quickly connecting and disconnecting the blade 75 from the yoke 76 and permitting the operator to interchange the blade 75 with the cornering wheel 31 and vice versa. In a typical taping operation, the operator first tapes the flat seams in a given room and then tapes the corners. When using the tool of the present invention, the operator attaches the blade 75 for taping the flat seams and upon completing of the flat seams, disconnects the blade and interchanges it with the cornering wheel 31. The operator then proceeds to tape the corner seams.

The advantage to the pivotable roller 41, pressure plate, or blade 75, as pivotably mounted in the present invention is that the pressure applying means whether it be the roller, the pressure plate, or the blade is allowed to pivot about a first axis of revolution extending generally laterally of the seam and generally parallel to the wall so as to bring the pressure applying means into pressing engagement with the tape 16 and the wall 18. The pressure applying means is further pivotable about a second axis so as to permit a uniform pressure to be applied laterally of the tape, when the longitudinal axis of the body of the taping tool is canted at an angle to a plane perpendicular to the wall and intersecting the wall along the seam to be taped. This latter pivoting action is particularly important in that it allows the operator to stand or to apply the force to the taping tool to one side of the seam being taped, thereby facilitating taping of horizontal seams which are above or below a horizontal plane within the comfortable reach of the operator.

What is claimed is:

1. In a dry wall taping tool for applying tape to elongated seams between adjoining sections of dry wall:

tool means having an elongated body portion to be grasped by the operator for movement along the seam by the operator and for applying tape over the seam to be taped;

drive wheel means rotationally coupled to said tool means for engagement with the tape and for pressing the tape into engagement with the wall and for pulling the tape from a tape supply associated with said tool means as said drive wheel means moves along the seam to be taped;

pressure means as a separate element from said drive wheel means for coupling to said tool means in pivotable relation relative to said elongated body portion of said tool means for pivoting about a first pivot axis extending generally laterally to the axis of elongation of said elongated body portion and generally parallel to the wall and for engagement with the tape as pulled by said drive wheel means from the supply and for pressing the tape into engagement with the wall, said pressure means being additionally pivotable relative to said elongated body portion of said tool means about a second pivot axis extending generally laterally of the axis of elongation of said body portion and generally perpendicular to said first pivot axis for permitting said pressure means to pivot when coupled to said tool means for applying pressure laterally across the tape while the longitudinal axis of said elongated body portion of said tool means is canted at an angle to the plane normal to the plane of the wall and intersecting the plane of the wall along the seam to be taped; and wherein said drive wheel means comprises a pair of axially separated drive wheel portions and including an axle means coaxial with the axis of revolution of said drive wheel means, yoke means for providing pivotable support of said pressure means from said axle means, and a pivot pin means pivotably operatively associated with said yoke means and said pressure means for pivoting said pressure means about an axis of rotation coaxial with the axis of said pivot pin means and wherein the axis of rotation of said pivot pin means falls within a plane perpendicular to the axis of said axle means.

2. The apparatus of claim 1 including quick disconnect means for quickly coupling and decoupling said pressure means to said yoke means.

3. In a dry wall taping tool for applying tape to elongated seams between adjoining sections of dry wall:

tool means having an elongated body portion to be grasped by the operator for movement along the seam by the operator and for applying tape over the seam to be taped;

drive wheel means rotationally coupled to said tool means for engagement with the tape and for pressing the tape into engagement with the wall and for pulling the tape from a tape supply associated with said tool means as said drive wheel means moves along the seam to be taped;

pressure means as a separate element from said drive wheel means for coupling to said tool means in pivotable relation relative to said elongated body portion of said tool means for pivoting about a first pivot axis extending generally laterally to the axis of elongation of said elongated body portion and generally parallel to the wall and for engagement with the tape as pulled by said drive wheel means from the supply and for pressing the tape into engagement with the wall, said pressure means being additionally pivotable relative to said elongated body portion of said tool means about a second pivot axis extending generally laterally of the axis of elongation of said body portion and generally perpendicular to said first pivot axis for permitting said pressure means to pivot when coupled to said tool means for applying pressure laterally across the tape while the longitudinal axis of said elongated body portion of said tool means is canted at an angle to the plane normal to the plane of the wall and intersecting the plane of the wall along the seam to be taped;

wherein said drive wheel means includes a pair of axially separated drive wheel portions, and wherein said pressure means includes a roller disposed between said pair of drive wheel portions; and including a first axle means extending generally parallel to or coaxial with the axis of revolution of said drive wheel means and disposed inbetween said drive wheel portions for pivotably supporting said roller, yoke means for providing pivotable support of said roller from said first axle means, a second axle means extending parallel to said first axle means and disposed inbetween said pair of drive wheel portions for rotationally supporting said roller, said roller being mounted on said second axle means for rotation thereon, and a pivot pin means pivotably interconnecting said yoke means and said second axle means for supporting said second axle from said first axle means and for pivoting said second axle means about an axis of rotation coaxial with the axis of said pivot pin means, and wherein the axis of rotation of said pivot pin means falls in a plane perpendicular to the axis of said first axle.

4. In a dry wall taping tool for applying tape to elongated seams between adjoining sections of drywall:

tool means having an elongated body portion to be grasped by the operator for movement along the seam by the operator and for applying tape over the seam to be taped;

drive wheel means rotationally coupled to said tool means for engagement with the tape and for pressing the tape into engagement with the wall and for pulling the tape from a tape supply associated with said tool means as said drive wheel means moves along the seam to be taped;

pressure means as a separate element from said drive wheel means for coupling to said tool means in pivotable relation relative to said elongated body portion of said tool means for pivoting about a first pivot axis extending generally laterally to the axis of elongation of said elongated body portion and generally parallel to the wall and for engagement with the tape as pulled by said drive wheel means from the supply and for pressing the tape into engagement with the wall, said pressure means being additionally pivotable relative to said elongated body portion of said tool means about a second pivot axis extending generally laterally of the axis of elongation of said body portion and generally perpendicular to said first pivot axis for permitting said pressure means to pivot when coupled to said tool means for applying pressure laterally across the tape while the longitudinal axis of said elongated body portion of said tool means is canted at an angle to the plane normal to the plane of the wall and intersecting the plane of the wall along the seam to be taped;

including dry wall tape cement dispensing means for applying cement to the side of the tape which is to face the wall as the tape is pulled by said drive wheel means from the tape supply, and wherein said pressure means presses the cement laden tape into engagement with the wall;

wherein said pressure means includes blade means which when coupled to said tool means is dimensioned to extend laterally of the seam being taped by an extent sufficient to bear against the wall on opposite lateral marginal side edges of the tape for smoothing the tape on the wall, for squeezing excess cement from under the tape and for feathering the cement onto the wall along opposite marginal side edges of the tape as applied to the wall joint being taped; and wherein said blade means is curved with a concave curvature facing in the direction of advancement of the taping tool along the seam being taped.

5. The apparatus of claim 4 wherein said blade extends laterally of the seam being taped by at least an amount equal to twice the width of the tape.

* * * * *